US008133540B2

(12) United States Patent
Wiley et al.

(10) Patent No.: US 8,133,540 B2
(45) Date of Patent: Mar. 13, 2012

(54) METHOD OF APPLYING A THERMALLY SETTABLE COATING TO A PATTERNED SUBSTRATE

(75) Inventors: Patrick Carl Wiley, Chilliwack (CA); Alan Juristovski, Burnaby (CA)

(73) Assignee: Flint Trading, Inc., Thomasville, NC (US)

( * ) Notice: Subject to any disclaimer, the term of this patent is extended or adjusted under 35 U.S.C. 154(b) by 1022 days.

(21) Appl. No.: 11/924,421

(22) Filed: Oct. 25, 2007

(65) Prior Publication Data

US 2008/0182016 A1 Jul. 31, 2008

Related U.S. Application Data

(63) Continuation-in-part of application No. 10/622,634, filed on Jul. 21, 2003.

(30) Foreign Application Priority Data

Dec. 3, 2002 (WO) ..... PCT/CA02/01864

(51) Int. Cl.

| | |
|---|---|
| ***E01C 7/06*** | (2006.01) |
| ***E01C 23/14*** | (2006.01) |
| ***C08J 5/12*** | (2006.01) |
| ***B32B 37/06*** | (2006.01) |
| ***B05D 5/10*** | (2006.01) |
| ***B05D 3/02*** | (2006.01) |

(52) U.S. Cl. ..... 427/372.2; 427/271; 427/256; 427/299; 404/75; 404/77; 404/79; 156/308.2; 156/309.6; 156/359; 156/380.9

(58) Field of Classification Search ..... 404/75, 404/77, 79; 156/308.2, 309.6, 359, 380.9; 427/256, 271, 299, 372.2

See application file for complete search history.

(56) References Cited

U.S. PATENT DOCUMENTS 1,063,752 A 6/1913 Walling (Continued)

FOREIGN PATENT DOCUMENTS

CA 2 361 056 5/2002

(Continued)

OTHER PUBLICATIONS

3M Applciation of Stamark Pre-Cut Symbols and Legends, Information folder 5.8 Feb. 2002 p. 6.*

(Continued)

*Primary Examiner* — Timothy Meeks
*Assistant Examiner* — Cachet Sellman
(74) *Attorney, Agent, or Firm* — Oyen Wiggs Green & Mutala LLP

(57) ABSTRACT

This application relates to a method of applying a thermally settable coating to a patterned substrate, such as an asphalt surface. The coating is applied in one or more preformed thermoplastic sheets and heated in situ to conform the thermoplastic material to the pattern formed in the underlying substrate. In one embodiment of the invention a pattern is formed in the asphalt surface using a removable template which is impressed into the asphalt when it is in a pliable state. The pre-formed sheets are then applied to the patterned surface and gradually heated. In an alternative embodiment of the invention the template is impressed into the pre-formed sheet and asphalt surface simultaneously after the sheet has been heated to a suitable temperature in situ. A bond reduction agent may be used to minimize adhesion between the template and the heated thermoplastic material. In a further alternative embodiment of the invention the thermoplastic material may be stamped after it has melted and partially cooled to cause the thermoplastic to more precisely conform to the underlying pattern.

9 Claims, 12 Drawing Sheets

U.S. PATENT DOCUMENTS

| | | | | | |
|---|---|---|---|---|---|
| 1,950,169 | A | | 3/1934 | Farasey | |
| 2,196,890 | A | | 4/1940 | Bensen | |
| 2,237,152 | A | | 4/1941 | Larmour | |
| 2,595,142 | A | | 4/1952 | Herck | |
| 2,866,992 | A | | 1/1959 | Toulmin, Jr. | |
| 2,898,825 | A | | 8/1959 | Walker et al. | |
| 3,070,557 | A | * | 12/1962 | Gessler et al. | 524/567 |
| 3,235,436 | A | * | 2/1966 | Eigenmann | 156/523 |
| 3,386,876 | A | * | 6/1968 | Wyckoff | 428/134 |
| 3,410,185 | A | | 11/1968 | Harrington | |
| 3,664,242 | A | | 5/1972 | Harrington et al. | |
| 3,832,079 | A | * | 8/1974 | Moorhead | 404/72 |
| 3,874,806 | A | | 4/1975 | Grist et al. | |
| 3,910,711 | A | * | 10/1975 | Moorhead | 404/89 |
| 4,082,587 | A | | 4/1978 | Eigenmann | |
| 4,105,354 | A | | 8/1978 | Bowman | |
| 4,135,840 | A | | 1/1979 | Puccini et al. | |
| 4,376,007 | A | | 3/1983 | Eigenmann | |
| 4,656,722 | A | * | 4/1987 | Armstrong | 29/527.2 |
| 4,685,824 | A | | 8/1987 | Eigenmann | |
| 4,776,723 | A | | 10/1988 | Brimo | |
| 4,792,259 | A | | 12/1988 | Eigenmann | |
| 4,854,771 | A | * | 8/1989 | Corbin et al. | 404/79 |
| 4,889,666 | A | | 12/1989 | Kawasaki | |
| 5,033,906 | A | | 7/1991 | Jordan | |
| 5,082,715 | A | | 1/1992 | Lasch et al. | |
| 5,133,621 | A | | 7/1992 | Gonzales | |
| 5,215,402 | A | * | 6/1993 | Stowell et al. | 404/93 |
| 5,421,670 | A | | 6/1995 | Meirick | |
| 5,447,752 | A | | 9/1995 | Cobb | |
| 5,487,526 | A | | 1/1996 | Hupp | |
| 5,494,372 | A | | 2/1996 | Oliver et al. | |
| 5,502,941 | A | | 4/1996 | Zember et al. | |
| 5,560,734 | A | * | 10/1996 | McIntosh et al. | 404/15 |
| 5,653,552 | A | * | 8/1997 | Wiley et al. | 404/77 |
| 5,792,511 | A | | 8/1998 | Oliver et al. | |
| 5,857,453 | A | | 1/1999 | Caven et al. | |
| 6,024,511 | A | | 2/2000 | Ross | |
| 6,213,680 | B1 | | 4/2001 | Schaeffer et al. | |
| 6,217,254 | B1 | | 4/2001 | Wallgren et al. | |
| 6,227,454 | B1 | | 5/2001 | Wolf et al. | |
| 6,303,058 | B1 | | 10/2001 | Kelley et al. | |
| 6,382,871 | B1 | | 5/2002 | Ross | |
| 6,503,558 | B2 | | 1/2003 | Williamson | |
| 2003/0103810 | A1 | | 6/2003 | Wiley | |
| 2004/0048025 | A1 | | 3/2004 | Lohnes | |
| 2004/0105933 | A1 | | 6/2004 | Wiley | |
| 2005/0207840 | A1 | | 9/2005 | Oliver | |

FOREIGN PATENT DOCUMENTS

| | | | | |
|---|---|---|---|---|
| DE | 29 18 860 | | | 11/1980 |
| DE | 43 14 240 | A1 | | 11/1993 |
| EP | 41335 | A2 | * | 9/1981 |
| EP | 41335 | A | | 12/1981 |
| EP | 0 898 018 | A1 | | 2/1999 |
| FR | 1 596 269 | | | 7/1970 |
| FR | 2591143 | A1 | | 6/1987 |
| JP | 05098613 | A | | 4/1993 |
| JP | 08291508 | A | | 11/1996 |
| JP | 411029905 | A | | 2/1999 |
| JP | 02000345514 | A | | 12/2000 |
| JP | 2006063553 | A | | 3/2006 |
| WO | WO 87/02724 | | | 5/1987 |
| WO | WO 03/048458 | A1 | | 6/2003 |

OTHER PUBLICATIONS

Letter dated Dec. 19, 2003 from Laura Jensen, President of Flint Trading, Inc.

Letter dated Feb. 19, 2004 from Vagn Askjaer, Product Supply Manager of Flint Trading, Inc.

Letter dated Feb. 20, 2004 from Vagn Askjaer, Product Supply Manager of Flint Trading, Inc.

Letter dated Feb. 26, 2004 from Vagn Askjaer, Product Supply Manager of Flint Trading, Inc.

Cataphote, Cata-Groove Snow Plow Resistant Thermoplastic Marking Material, pp. 1-5, dated Jul. 1998.

3M Guidelines for Pavement Marking Applications in Grooved Pavement Surfaces: Stamark Pavement Marking Tape and Stamark Liquid Pavement Markings, Information Folder 5.18 Grooving Applications (Apr. 2002).

3M Application of Stamark Pre-Cut Symbols and Legends, Information folder 5.8 (May 2002).

"Pavements and Surface Materials", Technical Paper No. 8, by Jim Gibbons, 1999.

"Installing thermoplastic crosswalks at the University of Wisconsin", Pavement Magazine, pp. 12-14, Feb. 2004.

PREMARK road marking material, from www.intertraffic.com, no date.

"Distincitive Concrete", from www.distinctiveconcrete.com/products_stamp.htm, no date.

English Abstract of JP 08-291508.

Machine English Translation of JP 08-291508.

* cited by examiner

METHOD OF APPLYING A THERMALLY SETTABLE COATING TO A PATTERNED SUBSTRATE

RELATED APPLICATIONS

This application is a continuation-in-part of pending U.S. application Ser. No. 10/622,634 filed 21 Jul. 2003 which is hereby incorporated by reference.

This application claims priority on international application No. PCT/CA02/01864 filed 3 Dec. 2002 which is hereby incorporated herein by reference.

TECHNICAL FIELD

This application relates to a method of applying a thermally settable coating to a patterned substrate, such as an imprinted asphalt surface. The coating may be applying by placing one or more pre-formed thermoplastic sheets on the substrate and heating the sheets in situ to conform the thermoplastic material to the underlying pattern.

BACKGROUND

Various methods for forming patterns in asphalt surfaces and other substrates are known in the prior art. The Applicant is the owner of U.S. Pat. No. 5,215,402 which describes a method of forming a pattern in an asphalt surface using a removable template. The template is compressed into a pliable asphalt surface to imprint a predetermined pattern simulating, for example, the appearance of bricks, cobblestones, interlocking paving stones or the like. The template is then lifted clear of the asphalt surface and the asphalt is allowed to harden.

In one embodiment of the '402 invention a thin layer of a cementitious coating may be applied to the imprinted asphalt to enhance the brick and mortar or other desired visual effect. The decorative coating may be applied, for example, by applying concrete powder and a colorant in the form of a slurry which is spread throughout the asphalt surface and allowed to harden. This is a relatively time consuming and labour-intensive process. Various other acrylic, epoxy or latex-based protective coatings may similarly be applied to the imprinted surface after the impression step to seal the surface and enhance its visual appeal.

One drawback to the '402 method is that the decorative coating may wear off over time, particularly in high traffic areas. Further, as mentioned above, application of coatings in a liquid form is time consuming and poses technical difficulties. For example, if the coating is not spread to a consistent depth an unappealing visual effect may result. The need has therefore arisen for improved methods for coating asphalt surfaces by application of heat to pre-formed thermoplastic sheets.

It is known in the prior art to impress patterns in thermoplastic coatings on-site for functional or decorative purposes. For example, Prismo Universal Corporation has used and described a process for applying a relative thick layer (i.e. approximately 15 mm) of thermoplastic to an underlying substrate in a heated, pliable form. The thermoplastic is then manually stamped in the desired pattern by applicators wearing insulated, heat-protective clothing. The process is very labour-intensive and potentially dangerous. Since the stamping is performed manually, it is difficult to consistently render complicated patterns over large surface areas. Moreover, the stamping is intended to impress patterns in the thick thermoplastic layer rather than the underlying substrate.

The need has therefore arisen for improved methods and materials for applying a thermally settable coating to a patterned substrate, such as an imprinted asphalt surface.

SUMMARY OF INVENTION

In accordance with the invention, a method of applying a coating to a substrate is provided comprising (a) forming a first pattern in the substrate; (b) placing a pre-formed thermally settable sheet on the substrate; and (c) heating the sheet in situ to a temperature sufficient for the sheet to adhere to the substrate in a configuration conforming to the first pattern.

Preferably the sheet is formed of a thermoplastic material and the substrate is an asphalt surface. The sheet may include a first surface in contact with the asphalt surface and a second surface not in contact with the asphalt surface. The sheet preferably has a thin profile so that the thermoplastic is coated on the asphalt surface in a thickness between 30-150 mil., or more preferably between 50-125 mil.

The first pattern may be formed in the asphalt surface when it is in a pliable state. For example, the first pattern may be formed in a recently formed asphalt surface comprising hot asphalt or in a pre-existing, re-heated asphalt surface. In one embodiment the first pattern is formed by placing a template on the asphalt surface while it is in a pliable state; imprinting the template into the asphalt surface to form the first pattern; and removing the template from the asphalt surface to expose the pattern.

The step of heating the sheet in situ may comprise gradually increasing the temperature of the sheet by providing a heating apparatus having a support frame extending over the sheet, the apparatus having at least one heater which is mounted for movement on the support frame in a travel path which periodically passes over the sheet. The sheet may be heated to a temperature between approximately 150-450° F., or more preferably 300-400° F.

The sheet may be subdividable into a plurality of discrete sections. Additionally or alternatively, a plurality of separate sheets may be provided which may be aligned adjacent one another to cover the asphalt surface. The size, shape, color and texture of the sheets may be selected for functional and/or decorative purposes. For example, each sheet may be formed in a second pattern which matches the first pattern formed in the asphalt surface.

In an alternative embodiment of the invention the first pattern may be formed in the thermoplastic sheet and the substrate simultaneously. In this embodiment the pre-formed thermally settable sheet is placed on an unpatterned substrate. The sheet in then gradually heated in situ to a temperature sufficient for the first surface of the sheet to adhere to the substrate. The sheet and the substrate are then imprinted to form the first pattern, such as by compressing a template placed on the second, exposed surface of the sheet. Prior to placing the template on the sheet second surface, the second surface may be treated with a bond reduction agent or coolant to minimize adherence between the template and the hot thermoplastic material of the pre-formed sheet.

In a further alternative embodiment of the invention the thermoplastic may be stamped after it is heated with a second template to cause the thermoplastic to more precisely conform to the first pattern.

BRIEF DESCRIPTION OF DRAWINGS

In drawings which illustrate embodiments of the invention, but which should not be construed as restricting the spirit or scope of the invention in any way.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 4:
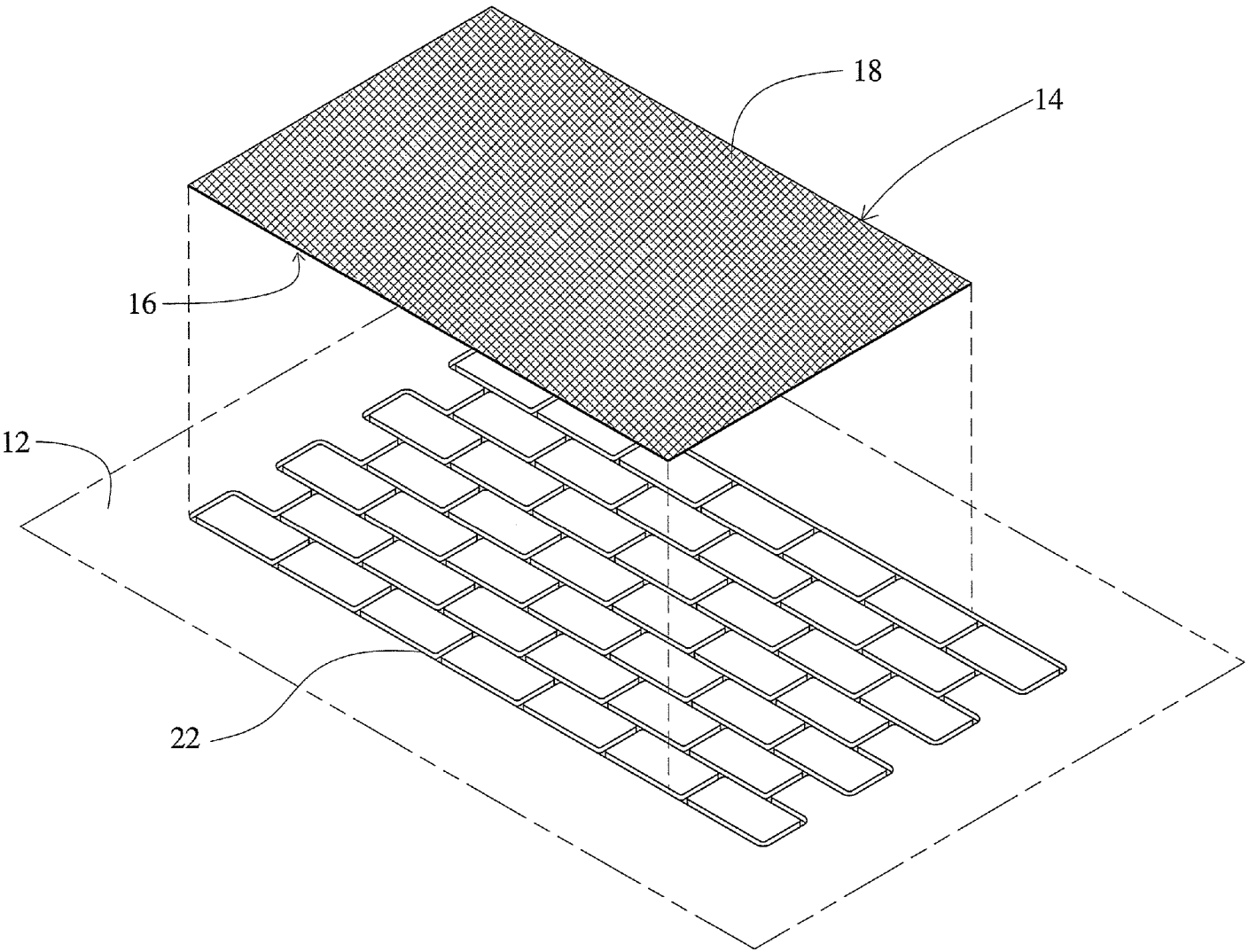
FIG. 4 is an exploded, perspective view of a pre-formed thermoplastic sheet being placed on a patterned asphalt surface.
Figure 5:
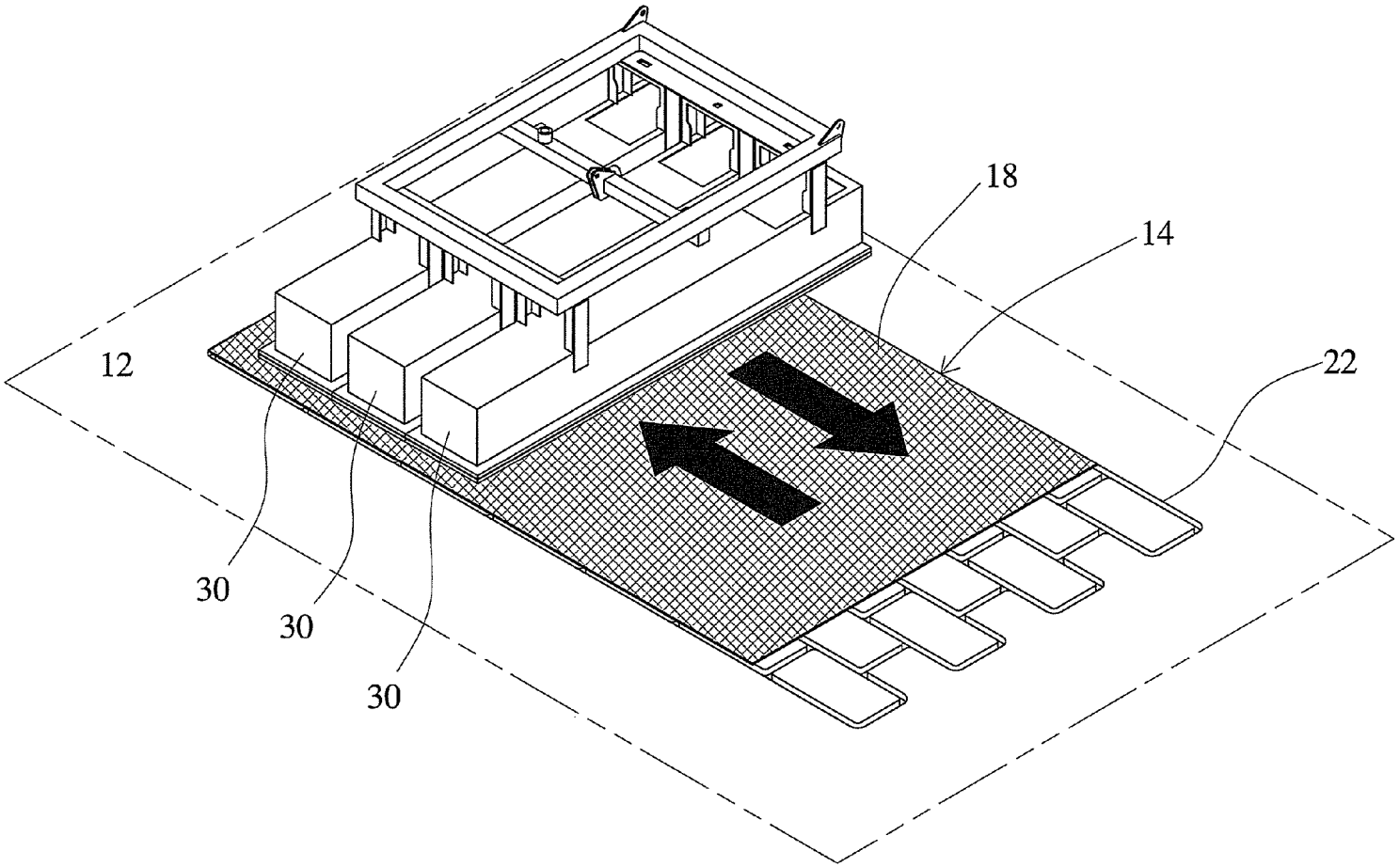
FIG. 5 is a perspective view showing the heaters of the apparatus of FIG. 3 passing over the pre-formed sheet of FIG. 4.
Figure 6:
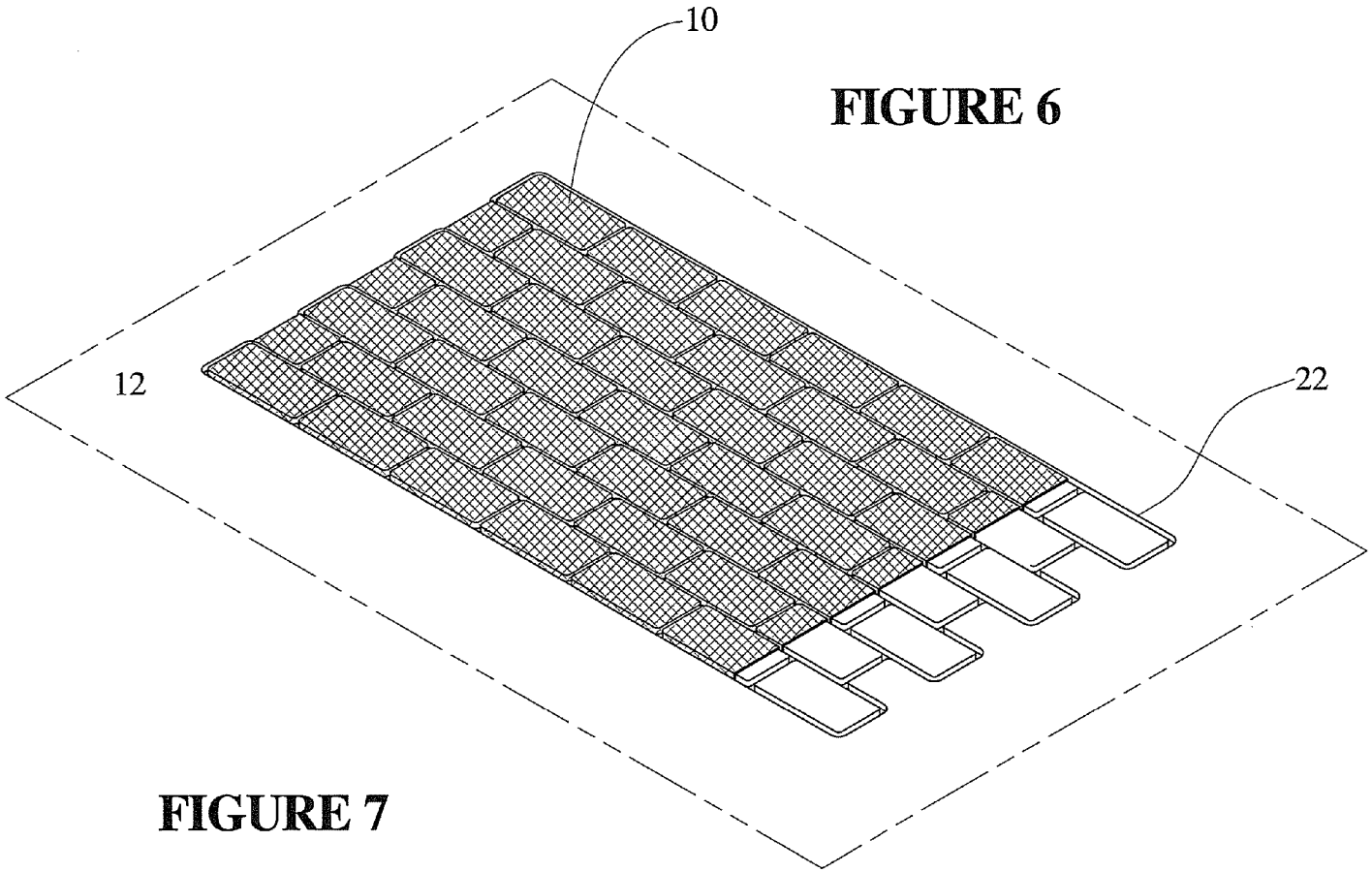
FIG. 6 is a perspective view showing the thermoplastic material of the sheet of FIGS. 4 and 5 melted on the patterned asphalt surface to form a coating thereon.
Figure 7:
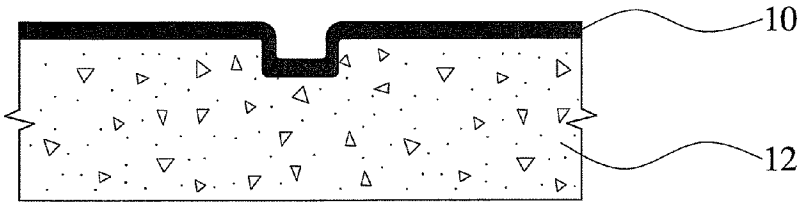
FIG. 7 is a cross-sectional view showing the coating conforming to the contour of the patterned asphalt surface.

This application relates to a method of applying a thermally settable coating 10 to a patterned substrate, such as an asphalt surface 12. As shown in FIGS. 4-6, coating 10 may be initially applied to asphalt surface 12 in the form of one or more pre-formed sheets 14. Sheets 14 are then gradually heated in situ as described below until a consistent bond is achieved between sheets 14 and asphalt surface 12, thereby forming coating 10. The heating process causes sheets 14 to conform to a pattern 22 formed in the underlying surface 12 to thereby enhance its decorative or functional effect (FIGS. 6 and 7).

As used in this patent application the term heating "in situ" refers to heating pre-formed sheets 14 at the installation site rather than applying hot thermoplastic in a liquid form in a conventional manner directly to asphalt surface 12 and allowing it to harden. As used in this patent application "asphalt" means a paving compound for constructing roads, driveways, walkways and the like which consists of a combination of bituminous binder, such as tar, and an aggregate, such as sand or gravel. As will be appreciated by a person skilled in the art, applicant's method could also be applied to other types of patterned substrates, such as concrete or other materials capable of receiving and adhering to settable coating 10.

Figure 8:
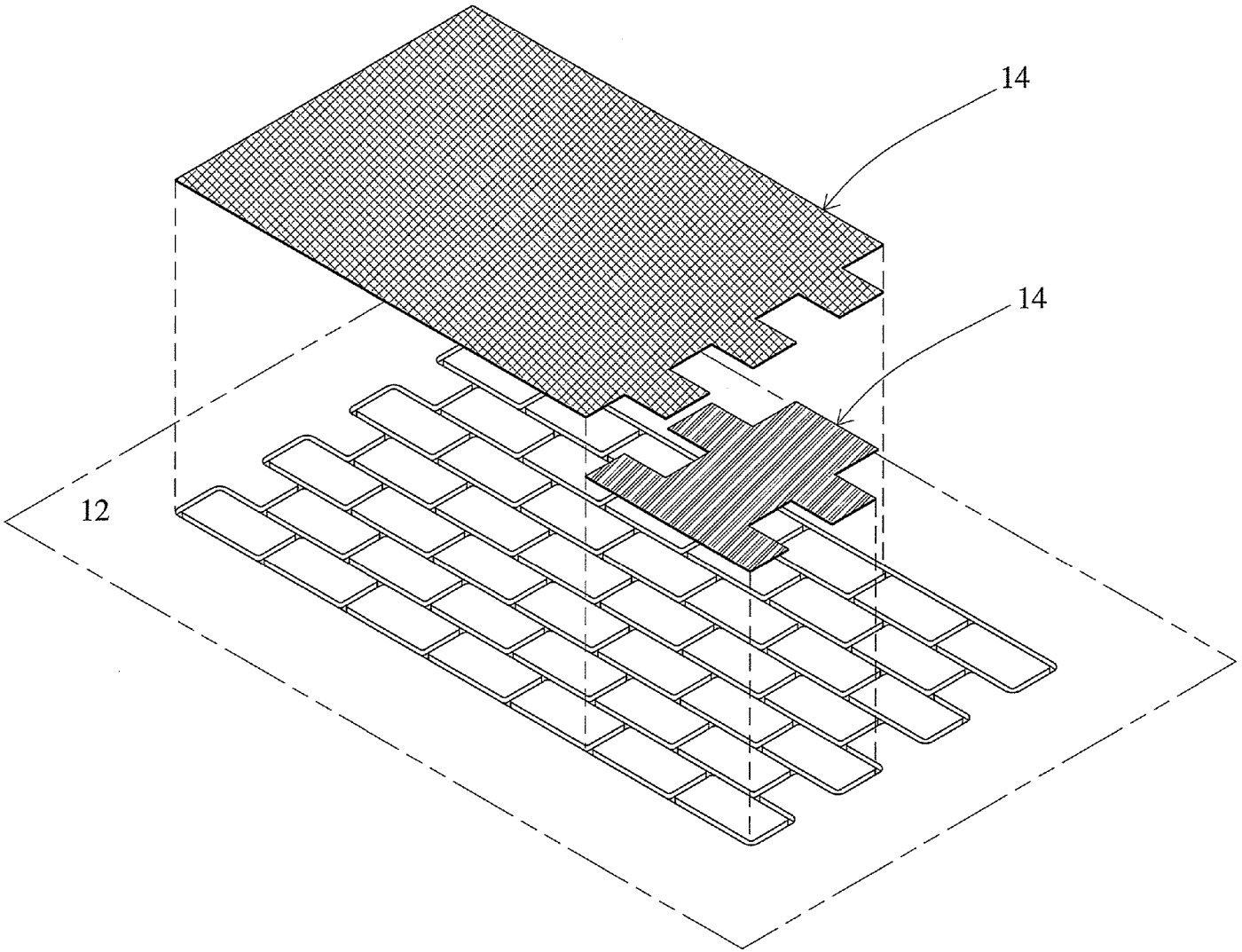
FIG. 8 is a an exploded, perspective view of a pair of pre-formed thermoplastic sheets being placed in alignment on a patterned asphalt surface.

As shown best in FIG. 4, each pre-formed sheet 14 has a first surface 16 which is placed in contact with asphalt surface 12 and a second, exposed surface 18 which is not placed in contact with asphalt surface 12. In one embodiment of the invention the thickness of each sheet 14 between surfaces 16, 18 is within the range of approximately 30-150 mil in thickness, or more particularly 50-125 mil in thickness. Sheets 14 may be formed from thermoplastic material and are available from various suppliers, such as Lafarge Road Markings, Flint Trading, Inc. and Avery Dennison Corporation. Sheets 14 may be selected for functional purposes, such as traffic markings or corporate logos, or may be purely decorative. As shown in FIG. 8, a plurality of sheets 14 may be juxtaposed together in a non-overlapping arrangement to completely cover asphalt surface 12. In an alternative embodiment, edge portions of adjacent sheets 14 could be partially overlapping. In another alternative embodiment sheets 14 may be arranged to only partially cover asphalt surface 12, such as by maintaining gaps between adjacent sheets 14. Further, each sheet 14 may either be continuous or discontinuous. For example, each sheet 14 could include openings or slots formed therein. As will be apparent to a person skilled in the art, the shape and configuration of sheets 14 may vary without departing from the invention.

Figure 1:
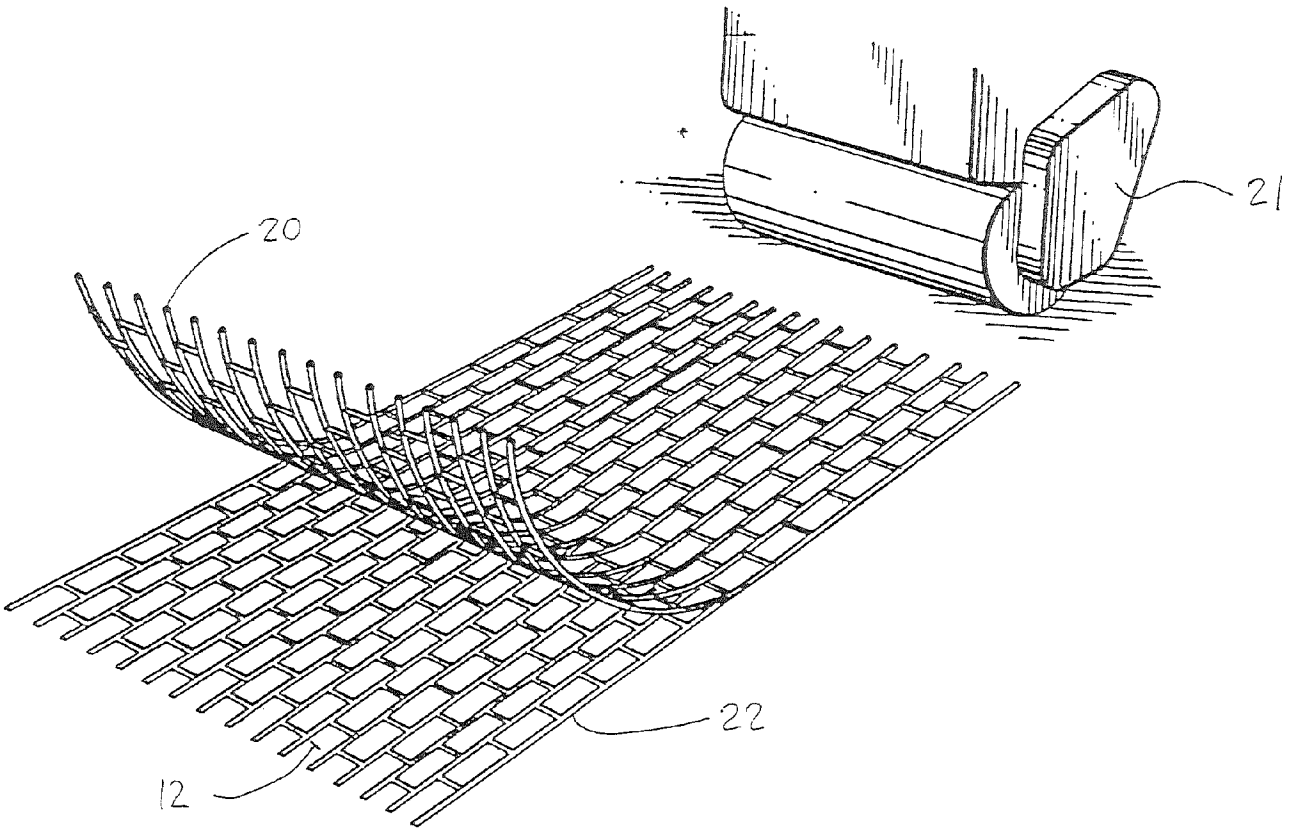
FIG. 1 is an perspective view of a template for forming a pattern in a pliable asphalt surface.
Figure 2:
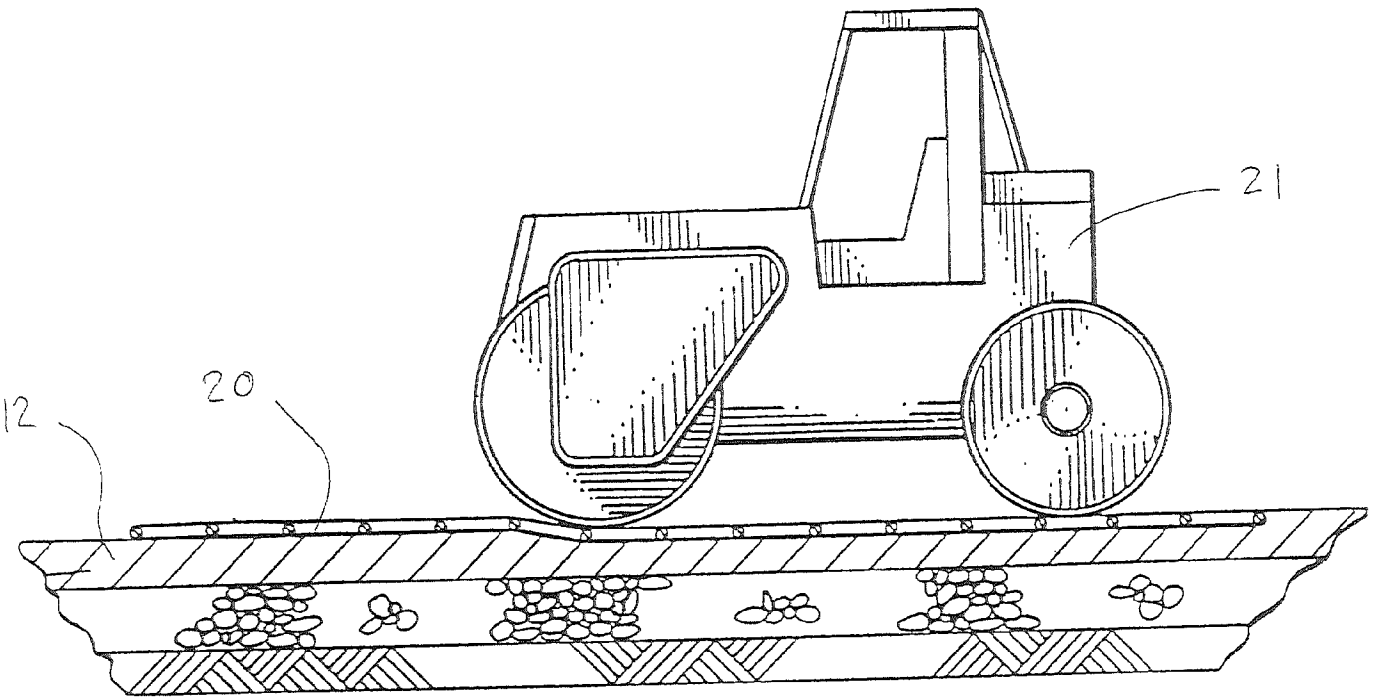
FIG. 2 is a diagrammatic side view of the template of FIG. 1 being compressed into an asphalt surface with a drum roller.

A pattern may be formed in asphalt surface 12, for example, according to the method of the Applicant described in U.S. Pat. No. 5,215,402 which is hereby incorporated by reference. More particularly, a template 20 is placed on asphalt surface 12 (FIGS. 1 and 2) while it is in a pliable state (i.e. after being freshly rolled with hot asphalt or after surface re-heating). Template 20 is then compressed into asphalt surface 12 with a drum roller 21 or some other compaction apparatus to form pattern 22 therein. For example, pattern 22 may be an impression simulating the appearance of bricks and mortar or some other decorative appearance. Template 20 is then removed from surface 12 to expose pattern 22 (FIG. 1). In alternative embodiments, pattern 22 could consist of protrusions rather than impressions formed in surface 12, or some other surface texturing. Other similar means for forming pattern 22 in asphalt surface 12 may be envisaged.

Figure 3:
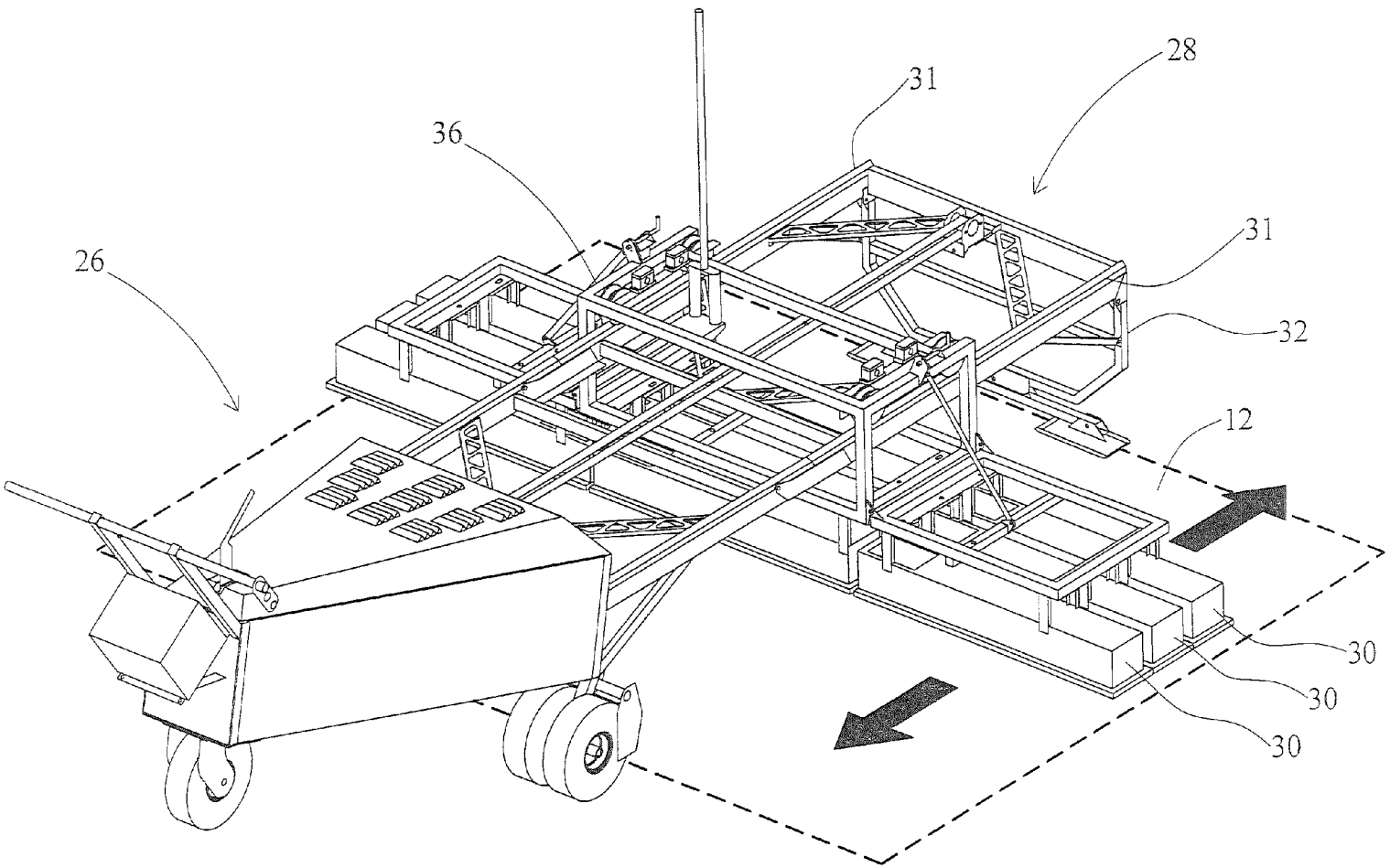
FIG. 3 is a perspective view of an apparatus comprising reciprocating infrared heaters for gradually heating a work site.

One means for heating sheets 14 in situ is shown in FIG. 3 and is described in WO 03/048458 A1 which is hereby incorporated by reference. In this embodiment, a portable surface heating apparatus 26 is provided for heating asphalt surface 12 and sheets 14 placed thereon. Preferably asphalt surface should be dry before the heating procedure commences. In the illustrated embodiment apparatus 26 includes a support frame 28 and a plurality of infrared heaters 30 supported for movement on support frame 28. For example, support frame 28 may include elongated rails 31 which are supported above asphalt surface 12 by support legs 32 and housing 34. A heater truck 36 is provided for reciprocating movement on rails 31.

Truck 36 supports a bank of heaters 30 at positions close to surface 12 (e.g. approximately 2 inches above the ground).

As shown in FIGS. 4 and 5, after pre-formed thermoplastic sheet 14 is placed on asphalt surface 12 overlying pattern 22, infrared heaters 30 are reciprocated over sheet 14 to gradually melt the thermoplastic material (in FIG. 5, only the portion of apparatus 26 comprising heaters 30 is illustrated to aid in clarity). An important advantage of the heating method of FIG. 1 is that a relatively large sheet 14, or group of sheets 14, and underlying asphalt surface 12 can be heated gradually and evenly. This approach avoids the disadvantages of hand-held torch heaters which cannot easily be used to evenly heat large areas and have a tendency to scorch the thermoplastic material and/or the underlying substrate. For example, depending upon their composition, some thermoplastic sheets 14 and/or asphalt surfaces 12 can scorch when subjected to sustained temperatures above approximately 325° F. In accordance with one embodiment of Applicant's heating method, asphalt surface 12 and thermoplastic sheet 14 are allowed to partially cool after each heating cycle. Thus the temperature of surface 12 (and sheet 14 applied thereto) increases gradually with successive heating cycles until the desired temperature suitable for thermoplastic/asphalt adhesion is achieved. The asphalt surface 12 is thereby subjected to a relatively slow heat soak to permit heat to gradually penetrate through and around sheet 14 below the uppermost surface layer of the asphalt. In accordance with one embodiment of the invention surface 12 and sheet 14 are gradually heated to a temperature within the range of 150-450° F. and most preferably within the range of approximately 150-450° F.

Figure 9:
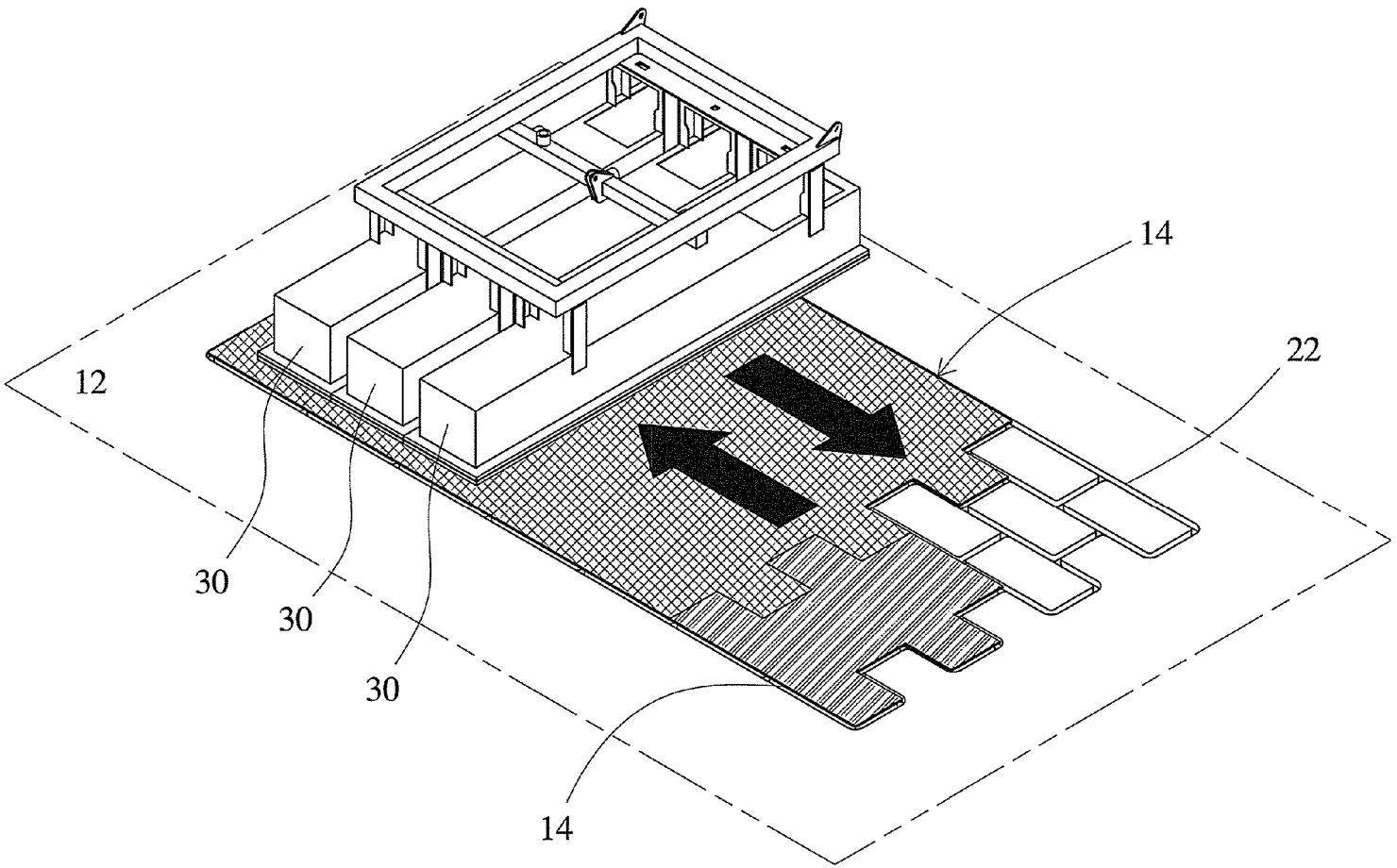
FIG. 9 is a perspective view showing the heaters of the apparatus of FIG. 3 passing over the pre-formed sheets of FIG. 8.

As shown in FIGS. 6 and 7, when sheet 14 is heated to a sufficiently high temperature it melts and conforms to pattern 22 formed in asphalt surface 12, forming a coating 10 thereon. The heat source is then removed and coating 10 is allowed to harden. In further embodiments of the invention colorants or additives may be applied to coating 10 while it is still tacky to create further surface texturing or augment the decorative effect. As shown in FIG. 6, coating 10 may be applied to all or part of the surface pattern 22 depending upon the visual effect desired. If multiple sheets 14 are employed (FIGS. 8 and 9), sheets 14 may be aligned edge to edge or gaps between adjacent sheets 14 may be maintained (i.e. portions of surface 12 imprinted with pattern 22 may remain uncoated).

Figure 10:
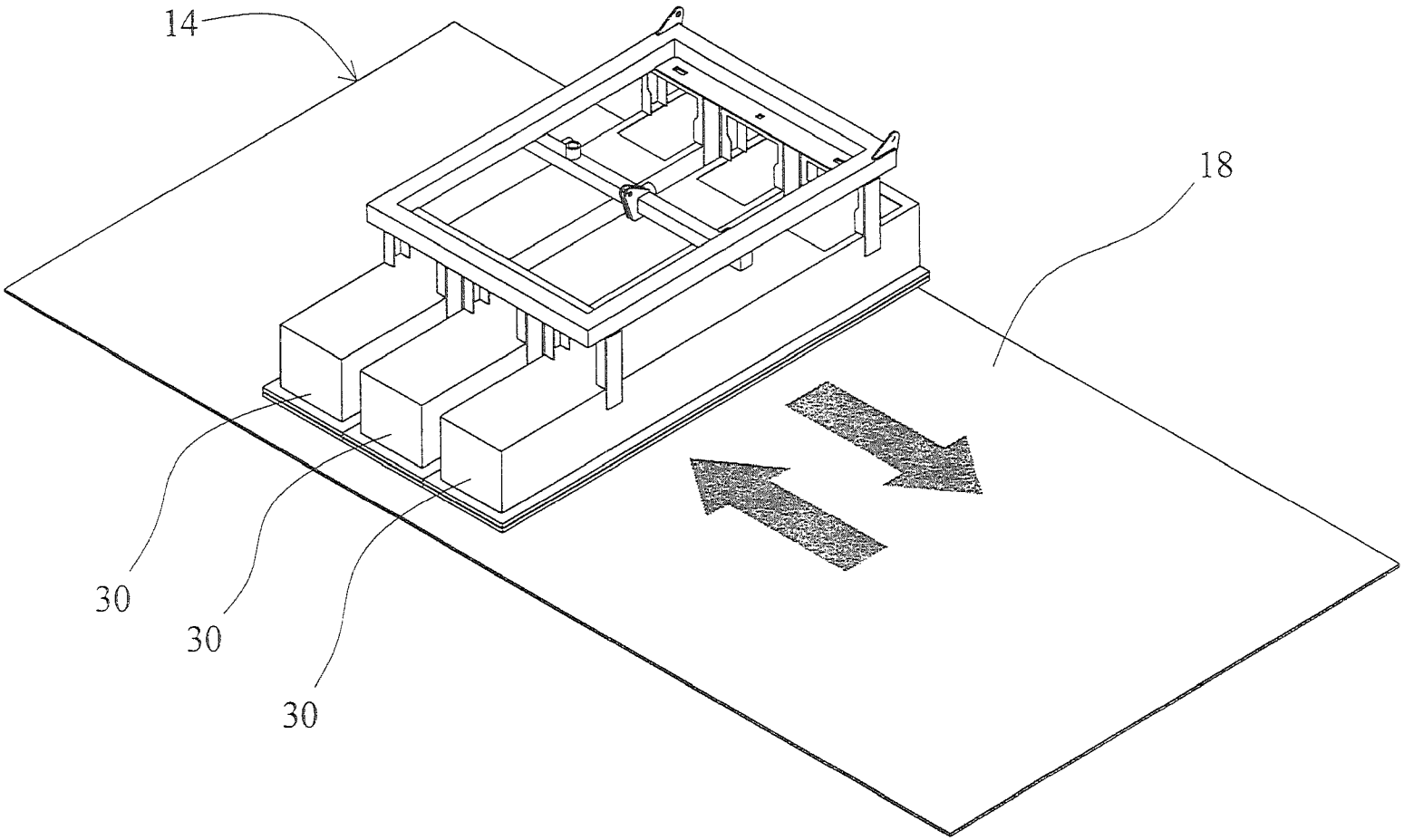
FIG. 10 is a perspective view of an alternative embodiment of the invention comprising placement of a pre-formed thermoplastic sheet on an unpatterned asphalt surface and bonding of the sheet to the surface using the heaters of FIG. 3.
Figure 11:
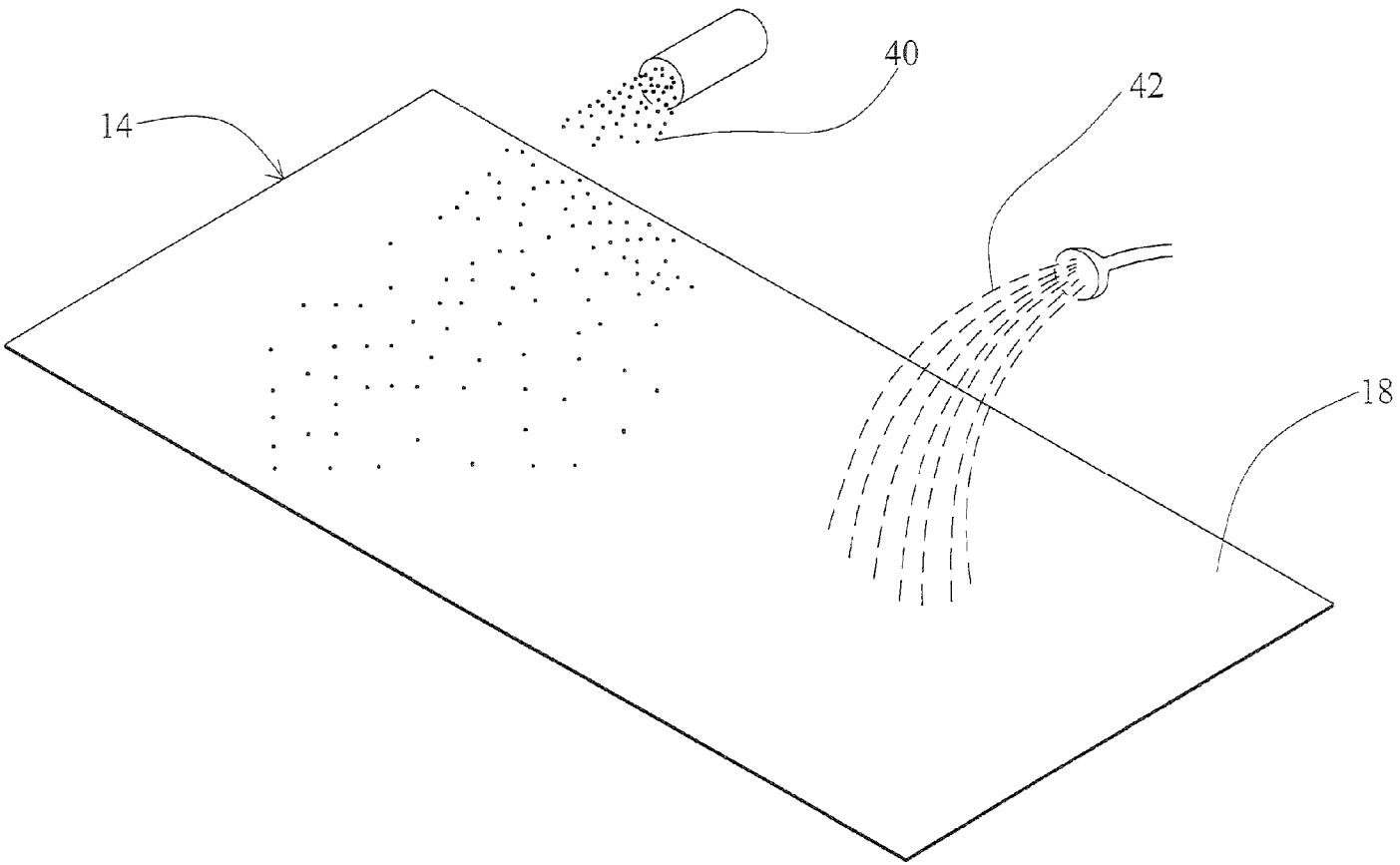
FIG. 11 diagrammatically illustrates the step of applying a bond reduction agent or a coolant to the exposed surface of the thermoplastic sheet.
Figure 12:
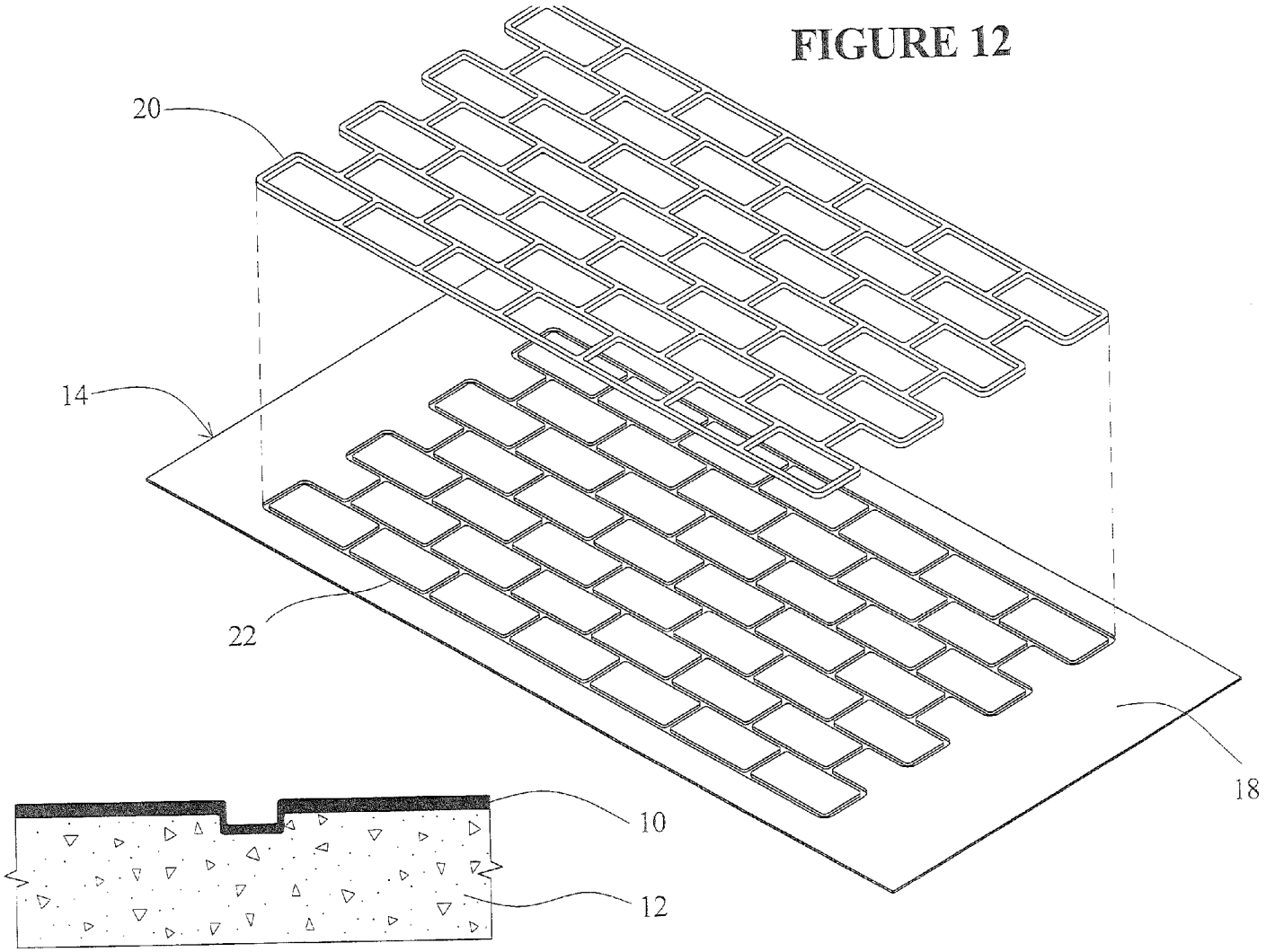
FIG. 12 is a perspective view illustrating the step of simultaneously forming a pattern in the thermoplastic coating and underlying asphalt surface using a removable template.

FIGS. 10-12 show an alternative embodiment of the invention where pattern 22 is formed in both asphalt surface 12 and sheet(s) 14 simultaneously rather than sequentially. In this embodiment a pre-formed sheet 14 is place on an unpatterned asphalt surface 12. Surface 12 may be in a freshly rolled, reheated or unheated state. As in the embodiment of FIG. 5, infrared heaters 30 may reciprocated over sheet 14 to gradually melt the thermoplastic material (FIG. 10). Once sheet 14 has been gradually heated to a sufficiently high temperature for adhesion to the underlying asphalt surface 12, a bond reduction agent is applied to the exposed surface 18 of sheet 14 (FIG. 11). For example, the bond reduction agent may be a particulate bond breaker 40, such as sand, or a liquid spray 42, such as water coolant, applied to layer 18. The purpose of the bond reduction agent is to minimize adhesion between layer 14 and the pattern forming device.

As shown in FIG. 12, the pattern forming device may comprise a removable template 20. In the illustrated embodiment, template 20 is used to simultaneously impress pattern 22 into both sheet 14 and underlying asphalt surface 12. The bond reduction agent referred to above minimizes adhesion between template 20 and the exposed surface 18 of sheet 14 while not affecting adhesion between surface 16 of sheet 14 and asphalt surface 12. The result is a patterned asphalt surface 12 having a thin thermoplastic coating 10 thereon (FIG. 12).

Figure 15:
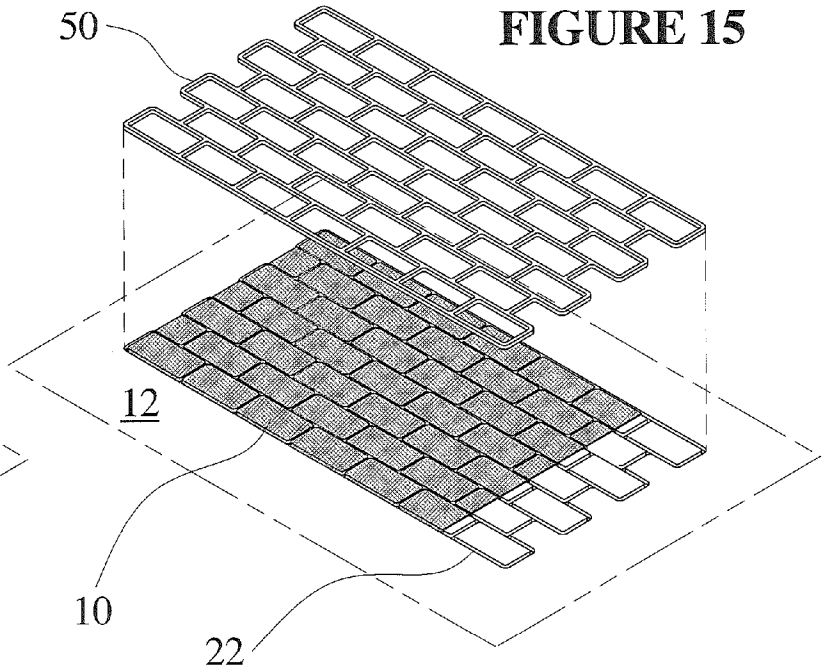
FIG. 15 is a perspective view showing a further template for stamping the thermoplastic of FIGS. 13 and 14 after it has partially cooled to produce a more precisely defined thermoplastic coating.
Figure 16:
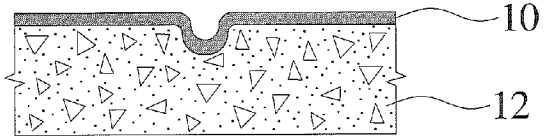
FIG. 16 is a cross-sectional view showing the coating of FIG. 15 after the thermoplastic has been stamped and the further template has been removed.
Figure 13:
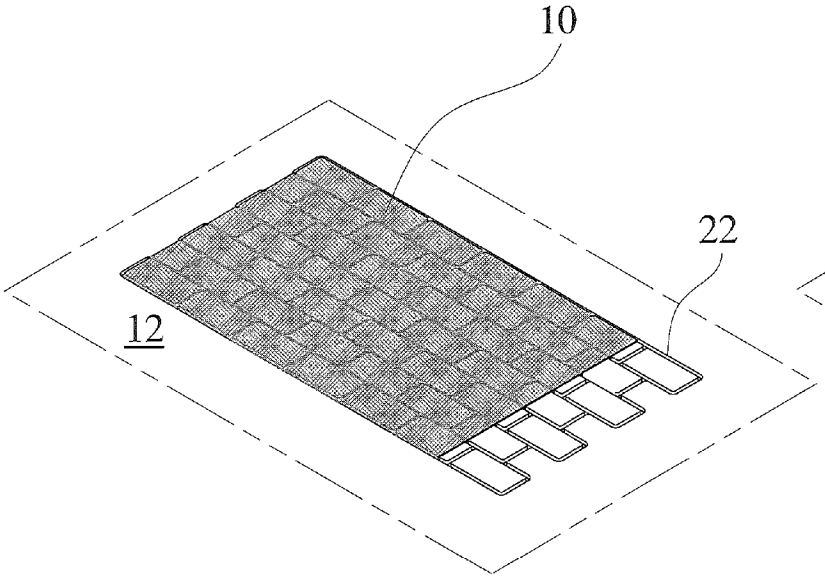
FIG. 13 is a perspective view of an alternative embodiment of the invention showing thermoplastic material derived from a relatively thick thermoplastic sheet melted on a patterned asphalt surface to form a coating thereon.
Figure 14:
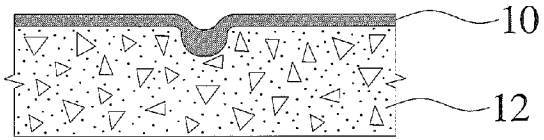
FIG. 14 is a cross-sectional view showing the coating of FIG. 13 conforming to the contour of the patterned asphalt surface.

FIGS. 13-16 illustrate a further embodiment of the invention. In this embodiment a pattern 22 is formed in asphalt surface 12 using a template 20 and sheet(s) 14 are then placed on the imprinted surface and heated in situ as described above. This causes sheet(s) 14 to melt and conform to pattern 22, forming a coating 10 on asphalt surface 12 (FIGS. 13 and 14). According to the further embodiment of the invention, the thermoplastic coating 10 is then allowed to partially cool and is subjected to a post-heating stamping step. By way of a non-limiting example, coating 10 may be allowed to cool to a temperature of 140° F., although the temperature may vary depending on the type of thermoplastic and ambient conditions. The post-heating stamping step may comprise placing a further template 50 on the partially cooled coating 10 while the thermoplastic is still pliable (FIG. 15). Preferably template 50 has a pattern matching the pattern of template 20 but has wire elements having a slightly smaller diameter to avoid displacing thermoplastic from the simulated grout line or other pattern during the stamping step. For example, template 20 may have wire elements approximately ⅜ inches in diameter and template 50 may have wire elements approximately ¼ inches in diameter. When template 50 is compressed in coating 10, it causes the thermoplastic to more precisely conform to the underlying pattern 22, resulting in a sharper and more well-defined visual appearance. This is evident by comparing the simulated grout line of FIG. 14, before the stamping step, with the simulated grout line of FIG. 16, after the stamping step. The grout line of FIG. 14 has a shallow, rounded profile whereas the grout line of FIG. 16 has a deeper, better defined rounded profile which more closely matches the contour and depth of pattern 22 formed in asphalt surface 12. The grout line of FIG. 16 therefore better simulates the desired visual effect.

Since in this embodiment of the invention the thermoplastic is subjected to a post-heating stamping step to more closely conform to the desired pattern, the thermoplastic sheets 14 may be somewhat larger in thickness than in other embodiments of the invention. As indicated above, sheets 14 are typically in the range of 30-150 mil in thickness, or more particularly 50-125 mil, or 90-120 mil in thickness. In this embodiment of the invention sheets 14 may be in the range of 150-250 mil in thickness, although sheets 14 of a lesser thickness may also be used. In particular embodiments of the invention sheets having a thickness in the range of 175-225 mil may be used. Thicker sheets 14 have the advantage of greater wearability and increased thermoplastic volume to act as a carrier for particulate additives, such as sand, silica or glass beads. The applicant's reciprocating heating system described herein has the advantage that it can evenly heat through comparatively thick thermoplastic sheets without causing scorching or incomplete melting.

As in one of the other embodiments of the invention described above, a bond reduction agent 40 may be applied to the exposed top surface of coating 10 before it is stamped to minimize adhesion between the thermoplastic and template 50. For example, a particulate bond breaker, such as sand or other aggregate, may be cast on coating 10 before template 50 is compressed therein (FIG. 15). This facilitates easy removal of template 50 after the compression step. The particulate bond breaker 40 becomes impregnated in the thermoplastic to provide enhanced wearability and a skid-resistant surface. Since thermoplastic sheets 14 are thicker than conventional sheets, as described above, a larger and more angular particulate may be used for optimum durability, as shown in FIGS.

14 and 16. For example, sand having an aggregate size exceeding 120 mil may be used.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of applying a thermoplastic coating to an asphalt substrate comprising:

(a) forming a first pattern in said substrate using a first template;

(b) placing a first pre-formed thermally settable sheet on said substrate;

(c) heating said sheet in situ to a temperature sufficient for said sheet to adhere to said substrate in a configuration conforming to said first pattern; and (d) stamping said thermoplastic using a second template to cause said thermoplastic to more precisely conform to said first pattern.

2. The method as defined in claim 1, wherein said first template and said second template are formed from a plurality of elongated elements defining said first pattern, and wherein said elongated elements in said second template are slightly smaller in diameter than said elongated elements in said first template.

3. The method as defined in claim 2, wherein said elongated elements in said second template are approximately ¼ inches in diameter and said elongated elements in said first template are approximately ⅜ inches in diameter.

4. The method as defined in claim 1, wherein said thermoplastic material is coated on said asphalt surface in a thickness between 150-250 mil.

5. The method as defined in claim 4, wherein said thermoplastic material is coated on said asphalt surface in a thickness between 175-225 mil.

6. The method as defined in claim 4, further comprising applying a particulate bond breaker to said thermoplastic prior to said stamping, wherein said stamping impregnates said bond breaker in said thermoplastic.

7. The method as defined in claim 6, wherein said particulate bond breaker is sand.

8. The method as defined in claim 7, wherein sand has an aggregate size exceeding 120 mil.

9. The method as defined in claim 1, comprising allowing said thermoplastic to partially cool after said heating and prior to said stamping said thermoplastic using said second template.

* * * * *